US011717834B2

(12) United States Patent
Marques et al.

(10) Patent No.: US 11,717,834 B2
(45) Date of Patent: Aug. 8, 2023

(54) COMMINUTION PROCESS OF IRON ORE OR IRON ORE PRODUCTS AT NATURAL MOISTURE

(71) Applicant: Vale S.A., Rio de Janeiro (BR)

(72) Inventors: Michelle Lacerda Sales Marques, Belo Horizonte (BR); Joaquim Donizetti Donda, Belo Horizonte (BR)

(73) Assignee: VALE S.A., Rio de Janeiro (BR)

( * ) Notice: Subject to any disclaimer, the term of this patent is extended or adjusted under 35 U.S.C. 154(b) by 0 days.

(21) Appl. No.: 16/771,637

(22) PCT Filed: Jul. 31, 2019

(86) PCT No.: PCT/BR2019/050307
§ 371 (c)(1),
(2) Date: Jun. 10, 2020

(87) PCT Pub. No.: WO2021/016681
PCT Pub. Date: Feb. 4, 2021

(65) Prior Publication Data

US 2021/0213461 A1 Jul. 15, 2021

(30) Foreign Application Priority Data

Jul. 30, 2019 (BR) ..... 1020190157097

(51) Int. Cl.
*B02C 21/00* (2006.01)
*B02C 4/02* (2006.01)
(Continued)

(52) U.S. Cl.
CPC ..... *B02C 21/00* (2013.01); *B02C 4/02* (2013.01); *B02C 23/12* (2013.01); *C22B 1/00* (2013.01)

(58) Field of Classification Search
CPC ..... B02C 21/00; B02C 4/02; B02C 23/12; B02C 23/08; C22B 1/00; B03B 9/00
See application file for complete search history.

(56) References Cited

U.S. PATENT DOCUMENTS 3,254,985 A * 6/1966 Merklin ..... C22B 1/2406 75/750
4,848,683 A * 7/1989 Kawatsu ..... B02C 2/005 241/300

(Continued)

FOREIGN PATENT DOCUMENTS

CN 103611681 A * 3/2014
CN 105268532 A * 1/2016

OTHER PUBLICATIONS

Reichert et al., Research of iron ore grinding in a vertical-roller-mill, Minerals Engineering 73 (2015) 109-115, Elsevier (Year: 2015).*

*Primary Examiner* — Shelley M Self
*Assistant Examiner* — P Derek Pressley
(74) *Attorney, Agent, or Firm* — ArentFox Schiff LLP

(57) ABSTRACT

This invention relates to a process of comminution of iron ore or iron ore products (pellet feed, sinter feed, etc.) at natural moisture without the need to add water or to include a drying step in the process, that is technically and economically feasible. The comminution process of this invention uses at least one piece of equipment selected from the group consisting of roller press (HPGR), vertical roller mill (VRM), roller crusher (RC) and high acceleration screen of at least 10G.

12 Claims, 6 Drawing Sheets

(51) Int. Cl.
*B02C 23/12* (2006.01)
*C22B 1/00* (2006.01)

(56) References Cited

U.S. PATENT DOCUMENTS 4,869,434 A * 9/1989 Folsberg ..... B02C 23/02 241/34
5,221,051 A * 6/1993 Hashimoto ..... B02C 21/002 241/97
5,908,166 A * 6/1999 Freitas ..... B02C 21/005 241/29
9,914,130 B2 * 3/2018 Burchardt ..... B02C 23/08

* cited by examiner

COMMINUTION PROCESS OF IRON ORE OR IRON ORE PRODUCTS AT NATURAL MOISTURE

CROSS-REFERENCE TO RELATED APPLICATIONS

This application is U.S. National Stage of PCT/BR2019/050307 filed Jul. 31, 2019, which claims priority to Brazilian Application No. BR1020190157097 filed Jul. 30, 2019. The entirety of which is incorporated herewith.

TECHNICAL FIELD

This invention relates to processes of comminution of iron ore or iron ore products at natural moisture. More particularly, this invention relates to processes for fine comminution iron ore containing the amount of water naturally present in it when extracted from the mine, or iron ore products (pellet feed, sinter feed, among others), resulting in important gains for both the process and the environment.

DESCRIPTION OF THE STATE OF THE ART

The comminution process refers to the fragmentation of the processed material to decrease particle size distribution.

A mineral comminution facility can be described by the combination of one or more unit operations. They are usually large-scale facilities capable of processing thousands of tons of ore per day.

Iron ore comminution is currently carried out basically in two ways: wet processing and dry processing.

This invention provides a new and inventive process of comminution of iron ore or iron ore products: processing at natural moisture. This invention's comminution at natural moisture is suitable for processing raw iron ore or ore products (pellet feed, sinter feed, etc.) with moisture up to 12% of its weight.

Natural moisture of mineral processing typically occurs in mining operations that involve the ore from the pit to screening and crushing it. From this moment on, the process will be carried out wet, with water added, or dry, with a drying step, for the ore to proceed to the subsequent processing steps.

Comminution in fine sizes (where the product has a particle size of less than 1 mm) requires classification equipment to separate fine fractions (desired product) from coarse fractions, where coarse fractions must be re-grinded in a closed circuit.

Iron ore concentration, subsequent to the crushing, grinding and classification stages in the ore processing, is addressed by document BR 102015003408-3. The system claimed by this patent, despite being made dry, is focused towards iron ore concentration by combining magnetic roller separators, aeroclassifiers, cyclones and bag filters. Also, the system in BR 102015003408-3 operates with materials containing 2 to 3% residual moisture.

The major difficulty of performing the crushing, grinding and classification steps under natural moisture is to produce a product with a particle size of less than 16 mm, as conventional screens are not able to perform this work efficiently and therefore do not guarantee the size distribution specification of the product. In addition, operational issues such as obstruction of sieve screens due to moisture are quite common.

For this reason, current comminution processes are carried out either completely wet or completely dry.

Dry and Wet Processing

Iron ore naturally has, on average, from 5% to 12% of its weight in water in its composition. This natural moisture makes the ore sticky or highly cohesive, which makes its beneficiation difficult.

Dry processing comprises the removal of water from the ore by means of a drying step which may be carried out, for example, by dryers, maintaining a residual water value in the ore of less than 1% by weight.

FIG. 1 represents the wet iron ore beneficiation process (ROM—Run of mine), commonly used in the state of the art. In wet processing, after the crushing and screening stage, large amounts of water are added to the ore.

The next step to crushing and screening is called grinding. This operation aims to increase fragmentation and adjust the size of the ore particles to a desired value. Typically, it is an operation carried out in conjunction with a classification step, particle size separation, using hydrocyclones or screens.

The wet grinding step is usually, but not limited, performed in ball mills or vertical mills with high consumption of electricity and water.

The wet processing route of iron ore products (pellet feed, sinter feed, among others), in the state of the art, can be seen on FIG. 2. Note that two grinding steps and an intermediate filtration step are required.

In the dry processing of iron ore (ROM), before grinding, there is a drying step that consumes a large amount of fuel used to heat the drying air. In addition, the drying step requires large facilities for removal of suspended ultrafines (dust) generated in ore processing and handling.

Dry grinding is usually combined with static and/or dynamic classifiers. The commonly used grinding equipment is ball mills which, as already mentioned, consume a large amount of electricity. FIG. 3 shows the process of dry iron ore beneficiation, commonly used in the state of the art.

The dry processing route of iron ore products (pellet feed, sinter feed, etc.), in the state of the art, can be viewed by means of FIG. 4.

Problems Generated by State of the Art Iron Ore Comminution Processes

Conventional processes of ore comminution and iron ore products use large amounts of water in their processing and/or energy and fuel for the drying step.

The environmental impact and liability generated by conventional iron ore processing plants are significant due to the amount of water consumed, loss of iron ore ultrafines, generation of combustion residues and particulate emissions (when drying is required), high energy consumption, among others.

Vertical Roller Mill, Roller Press, Roller Crusher and High Speed Screeners

On some grinding equipment commonly used in the cement and coal industry, such as the Vertical Roller Mill (VRM), the Roller Press (High Pressure Grinding Rolls, HPGR) and the Roller Crusher (RC), materials are fed with their natural moisture. The vertical roller mill (VRM) is commonly applied in grinding materials such as coal, lignite, limestone, clays, clinker.

The vertical mill (VRM) consists of a turntable and rollers which are arranged thereon and which move due to the rotation of the table. The material is introduced into the center and moves to the edges and in this path is comminuted by the rollers. These are connected to a hydraulic system that changes roll pressure according to the need for finer particle size material. After comminution, the particles are removed by an upward flow of air that can be heated, drying the ore at the same time that it is directed to a dynamic classifier, where particles with particle size below the one desired leave the mill and coarse particles return to the table to be comminuted. This equipment, therefore, is part of a completely dry processing, its main application being in the cement industry. It is also possible to operate by overflow, without the need of air to transport the material and without dynamic classification. To do so, however, it must operate with natural moisture or have a drying step prior to it.

The roller press (HPGR) is generally applied before or after the ore grinding step as an auxiliary grinding step. This equipment consists of a pair of rollers that rotate in opposite directions, supported on a rigid frame. The material to be grinded is fed into the upper part of the equipment between the rollers, and the compression of this particle bed is performed in openings larger than the maximum particle size in the feed. Thus, size reduction is made by interparticular comminution. The roller press has higher energy efficiency compared to conventional crushers and mills (e.g., ball mill) because the structural breakage of the material grains is performed with reduced energy loss in heat and noise.

The roller crusher (RC) is generally applied in the ore crushing step as an auxiliary comminution step. The equipment consists of rollers that rotate in opposite directions and the working principle is the crushing of particles between the rollers. The equipment is fed with a thin layer of ore and the rollers simultaneously touch the particles. The rollers work with an opening smaller than the largest particle size, regulated by the desired top size. For example, if a product with a 1 mm top size is required, the machine will have its opening set to this value or slightly less.

High acceleration screens (greater than 10G, where G is gravitational acceleration) have a high acceleration screen vibration system, promoting an ore release effect on the screen, which prevents its obstruction as well as enabling greater likelihood of ore being sorted/separated. In this invention, no water is sprayed on the ore in the sieves used.

It is important to note that high acceleration screens and vertical roller mills (VRM) have never been used in iron ore grinding/screening circuits. In addition, roller crushers (RC) have never been used for fine comminutions (less than 1 mm).

Objective and Advantages of the Invention

The objective of this invention is to provide an efficient comminution process for iron ore or iron ore products (pellet feed, sinter feed, among others) at natural moisture, with moisture up to 12% of its weight, without the need to add water or include a drying step in the process, in a technically and economically feasible manner. The focus of the invention is on the comminution of raw iron ore or iron ore products, with use and disposal of equipment employed in the beneficiation of materials with totally different chemical and physical characteristics, such as coal, lignite, limestone, clay and clinker.

An additional objective is to provide an efficient process of comminution of raw iron ore or iron ore products (pellet feed, sinter feed, etc.) at natural moisture, with up to 12% of its weight in moisture, to produce a product with a particle size of less than 16 mm in case of raw iron ore comminution and less than 0.074 mm in case of materials from iron ore products (sinter feed or pellet feed to comminute until the feeding size for pelletizing).

The comminution routes of the present invention have important advantages that benefit both the industrial process and the environment:

- Forgoing the use of water in the grinding process, reducing environmental impacts either by not consuming this natural resource, or by reducing the flow to be disposed in tailings dams;
- Forgoing the use of energy and fuels necessary for the drying process of the material;
- Increased processing efficiency of iron ore and iron ore products, with reduction in: energy consumption, size of facilities, cost of implementation of facilities, operating cost;
- Greater simplicity of operation;
- Reduced maintenance and replacement of worn materials used in the processing of raw iron ore and iron ore products compared to all-wet and all-dry routes;
- Reduction of auxiliary activities such as replacement of grinding media in ball mills (wet and dry);
- Iron ore ultrafine loss reduction;
- Forgoing an exhaust system or circuit for the removal of airborne ultrafines (dust) generated by ore processing and handling, as the natural moisture of the ore prevents the suspension of these particles.

BRIEF DESCRIPTION OF THE INVENTION

In order to achieve the above objectives, this invention provides process routes for comminution of iron ore or iron ore products at natural moisture, i.e. without the need to add water or a drying step to the process.

The invention consists of processing routes that combine grinding and classification equipment for a more efficient comminution process, such equipment being: Roller Press (HPGR), Vertical Roller Mill (VRM), Roller Crusher (RC) and a high acceleration screen of at least 10G.

Thus, the present invention is aimed at an iron ore comminution process carried out at natural moisture, either from a material coming directly from the mine (ROM) or from already processed iron ore products (pellet feed, sinter feed, among others), where the processing uses at least one of the following equipment: vertical roller mill (VRM), roller press (HPGR), roller crusher (RC) and high acceleration screen of at least 10G. For iron ore application, the vertical roller mill (VRM) will operate with overflow discharge and the ore drying option during grinding will not be used.

DESCRIPTION OF THE FIGURES

The detailed description given below refers to the attached figures, which.

DETAILED DESCRIPTION OF THE INVENTION

The following detailed description is in no way intended to limit the scope, applicability or configuration of the invention. More precisely, the following description provides the understanding necessary for the implementation of exemplary embodiments. Using the teachings herein, those skilled in the art will recognize convenient alternatives that may be used without extrapolating the scope of this invention.

As will be obvious to any person skilled in the art, the invention is directed to comminution in the iron ore beneficiation process, without addressing any other steps such as concentration, for example. However, the invention is not limited to such particular embodiments.

Figure 1:
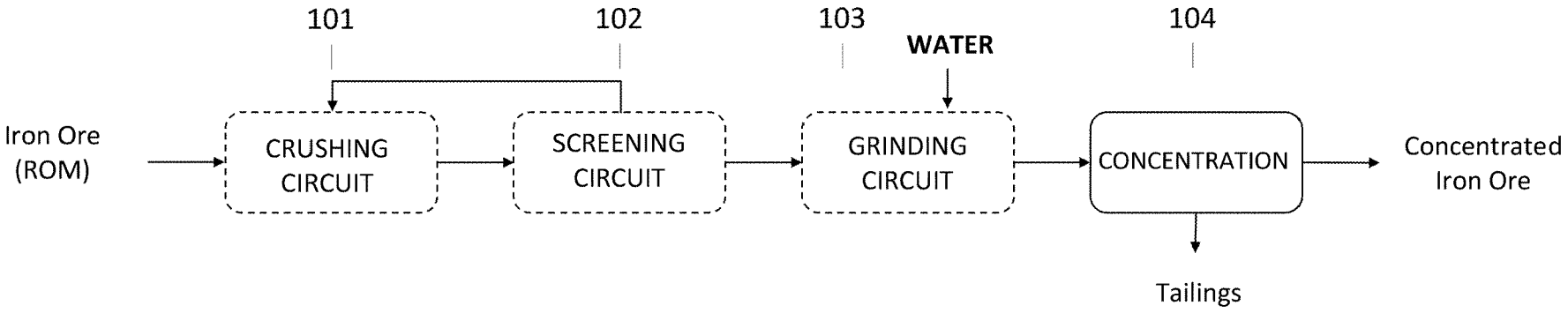
FIG. 1 illustrates a wet iron ore beneficiation process (ROM), according to the state of the art.

FIG. 1 shows a state-of-the-art process of wet iron ore beneficiation (ROM) containing the crushing 101, screening 102, grinding 103 and concentration 104 steps. Crushing step 101 may be performed in various stages (e.g. primary crushing to quaternary crushing), being carried out in closed circuit with screening step 102, which may be performed, for example, on vibrating screens. Grinding step 103 requires the addition of a significant volume of water. The ore concentration step 104 can be performed by gravitational, magnetic, flotation methods, etc.

Figure 2:
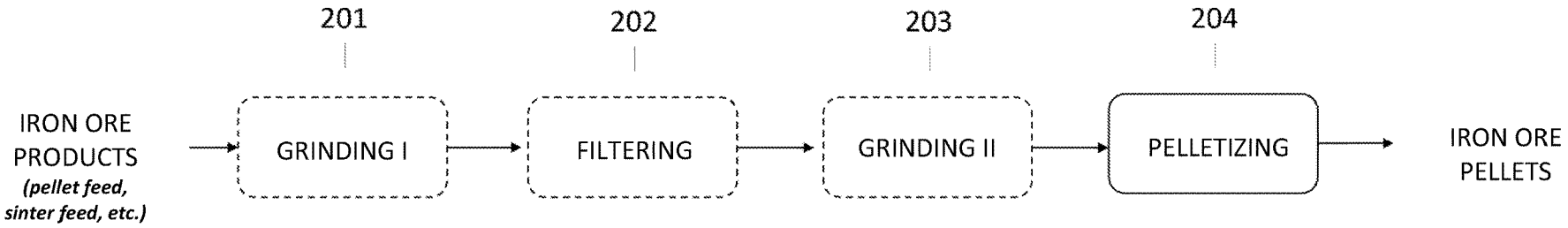
FIG. 2 illustrates a wet process of beneficiation of iron ore products (pellet feed, sinter feed, among others), according to the state of the art.

FIG. 2 shows a state-of-the-art process for beneficiation of wet iron ore products (pellet feed, sinter feed, etc.), where the comminution circuit contains a first grinding step 201, a filtration step 202 due to high moisture of the material, and a second grinding step 203. After comminution, the material goes through pelletizing step 204 to obtain the desired final product, which in this case is iron ore pellets.

Figure 3:
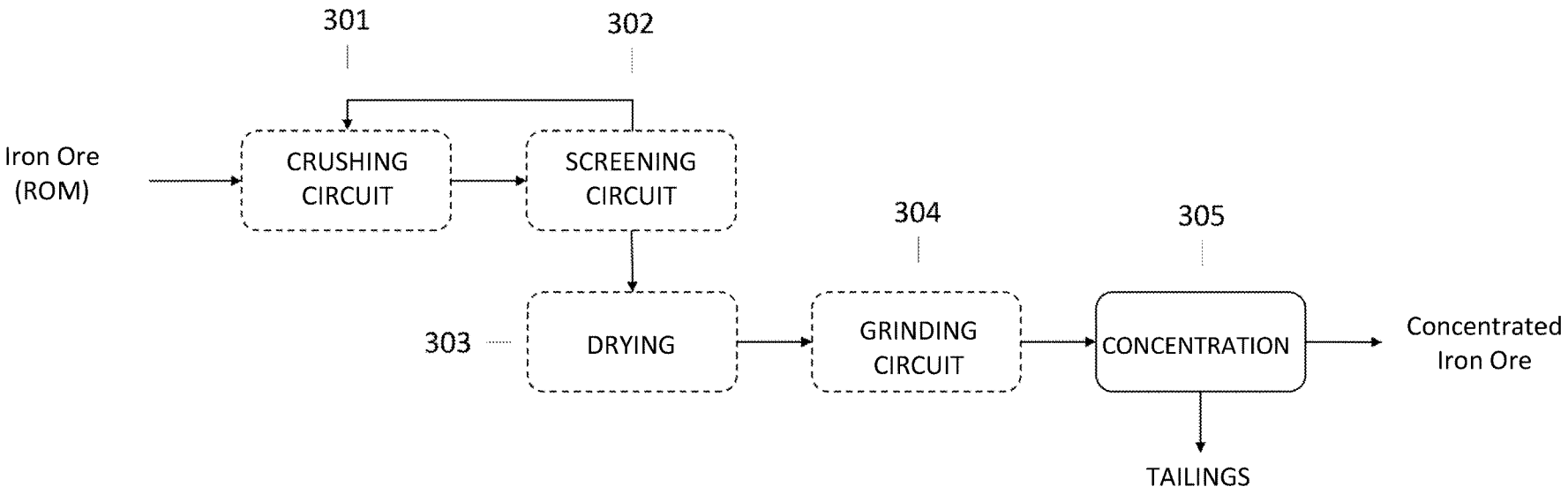
FIG. 3 illustrates a dry raw iron ore beneficiation process (ROM) according to the state of the art.

FIG. 3 shows a state-of-the-art process of dry iron ore beneficiation (ROM) containing crushing 301, screening 302, drying 303, grinding 304 and concentration 305 steps. Crushing step 301 may be performed in various stages (e.g. primary crushing to quaternary crushing), being carried out in closed circuit with screening step 302, which may be performed, for example, on vibrating screens. Drying 303 may occur within the grinding equipment itself by means of hot air flow from burners and blowers. Concentration 305 can be performed by gravitational, magnetic, electrostatic methods, etc.

Figure 4:
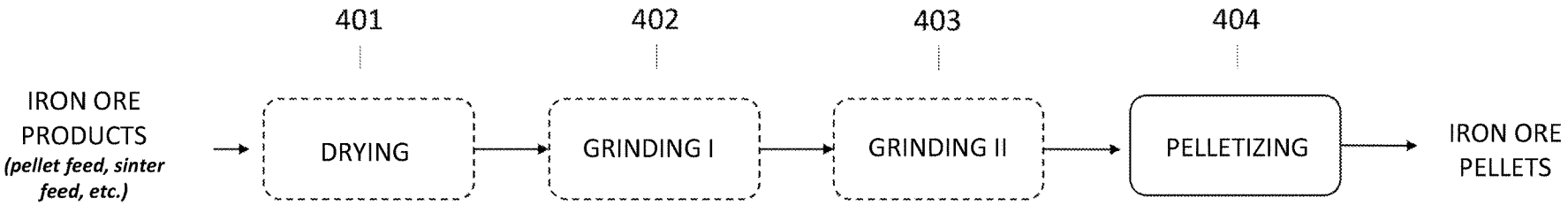
FIG. 4 illustrates a dry process of beneficiation of iron ore products (pellet feed, sinter feed, among others), according to the state of the art.

FIG. 4 shows a state-of-the-art process for dry iron ore product beneficiation (pellet feed, sinter feed, among others), where the comminution circuit contains a drying step 401, a first grinding step 402 and a second grinding step 403. After comminution, the material goes through pelletizing step 404 to obtain the desired final product, which in this case is iron ore pellets.

The following description will address (9) nine possible comminution routes of this invention. Routes apply for two iron ore source possibilities: 1) a first source of material coming directly from the mine (ROM), and 2) a second source of iron ore products already processed at the beneficiation plant (pellet feed, sinter feed, etc.) before entering this invention's process.

Figure 5:
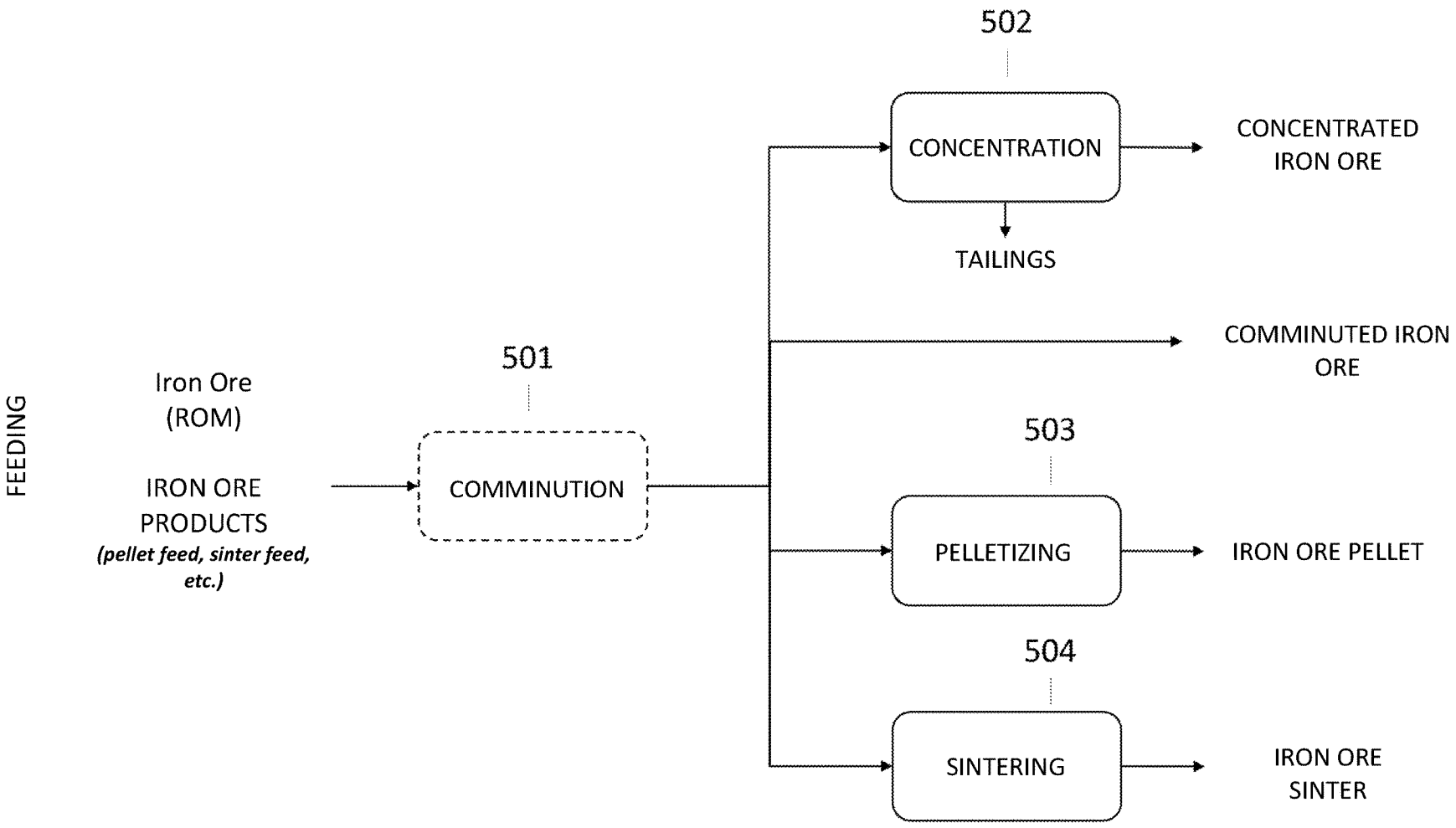
FIG. 5 illustrates the process of beneficiation of raw iron ore or iron ore products at natural moisture, according to this invention.

This invention, illustrated in a simplified manner by FIG. 5, is a beneficiation process whose comminution circuit 501 is fully performed at natural moisture, either from a material coming directly from the mine (ROM) with up to 12% moisture by weight, or already processed iron ore products (pellet feed, sinter feed, etc.), also with up to 12% moisture. After comminution 501, the final product may be the comminuted iron ore itself, or concentration 502, pelletizing 503 or sintering 504 stages may be carried out according to the desired final product.

Figure 6:
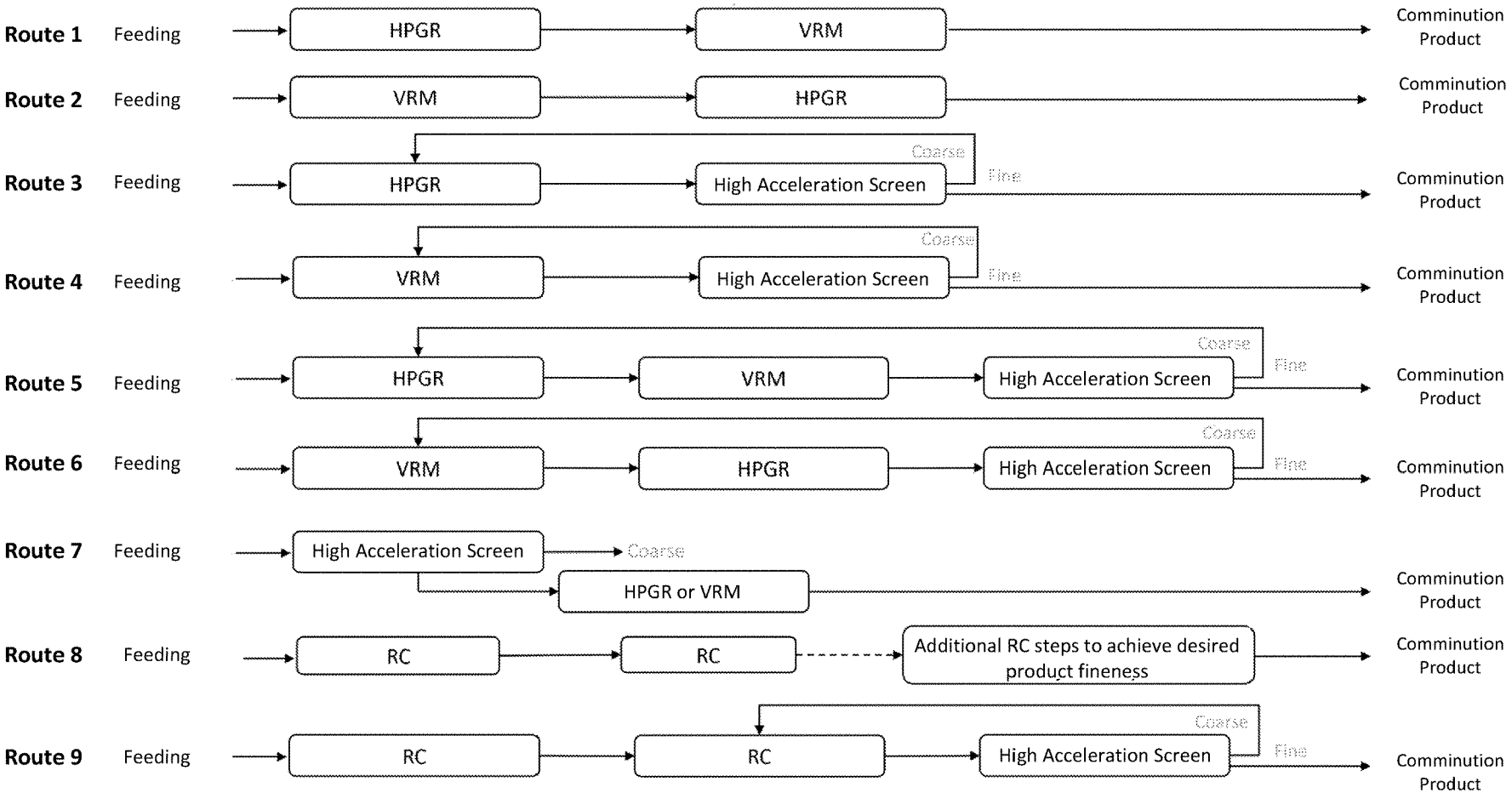
FIG. 6 shows the nine processing routes of this invention.

The 9 (nine) processing routes of the present invention are illustrated in detail in FIG. 6 and consist of:

Route 1: The comminution circuit 501, at natural moisture, occurs first in a roller press (HPGR) in up to three steps and is later reprocessed in a vertical roll mill (VRM) in up to three steps in series;

Route 2: The comminution circuit 501, at natural moisture, occurs first in a vertical roller mill (VRM) in up to three steps, and then is reprocessed in a roller press (HPGR) in up to three steps in series;

Route 3: Comminution circuit 501, at natural moisture, occurs in a roller press (HPGR) and is coupled in a closed circuit with a high acceleration screen (at least 10G) where the coarse product (retained material) will be directed back to the roller press (HPGR) and fine product (passing material) is the final comminution product;

Route 4: Comminution circuit 501, at natural moisture, occurs in a vertical roller mill (VRM) and is coupled in a closed circuit with a high acceleration screen (at least 10G), where the coarse product (retained material) will be redirected to the vertical roller mill (VRM) and the fine product (passing material) is the final comminution product;

Route 5: Comminution circuit 501, at natural moisture, starts at the roller press (HPGR), the material goes on to be processed in a vertical roll mill (VRM) and is then classified into a high acceleration screen (of at least 10G), where the coarse product (retained material) returns to the roller press (HPGR), closing the circuit, and the fine product (passing material) is the final comminution product;

Route 6: Comminution circuit 501, at natural moisture, starts at the vertical roller mill (VRM), the material goes on to be processed in a roller press (HPGR) and is then classified into a high acceleration screen (of at least 10G), where the coarse product (retained material) returns to the vertical roller mill (VRM), closing the circuit, and the fine product (passing material) is the final comminution product;

Route 7: In comminution circuit 501, at natural moisture, the material is classified by the high acceleration screen (of at least 10G), and its fine product (passing material) is processed by the roller press (HPGR) or vertical mill (VRM) in up to three steps. The product of the latter consists of the fine product, which is the final product of comminution; and coarse material (retained material) is also considered a product as it is traded in this way (sinter feed);

Route 8: Comminution circuit 501, at natural moisture, occurs in a roll crusher (RC) and can be performed in several steps in a comminution series using equipment with double rollers or more; and Route 9: The comminution circuit 501, at natural moisture, starts at the roller crusher (RC), and can occur in several steps in a comminution series using equipment with double rolls or more, and is then classified in a high acceleration screen (of at least 10G), where the coarse product (retained material) returns to the roller crusher (RC), closing the circuit, and the fine product (passing material) consists of the final product.

Tests have shown that the present invention produces different particle size products of less than 16 mm, particle size of less than 8 mm, particle size with up to 99.8% passing material in the 1 mm mesh and between 60% to 85% passing material in the 0.074 mm mesh.

Example 1

Pilot scale high-acceleration screen testing was performed using iron ore with about 50% passing material at 1 mm, 11% moisture and very high loss on ignition (LOI) (about 10%), which is characteristic of a cohesive material that is difficult to screen at natural moisture. The undersize recovery of the 1.0 mm mesh ranged from 35% to 41%, consistent with the amount of fines the sample had, which shows the efficiency of natural moisture screening even for such a cohesive material. Tables 1a, 1b and 1c show the chemical analysis, the particle size distribution of the tested sample and the undersize and oversize partition obtained in the pilot tests, as well as the mass balance of the test.

TABLE 1a

| Chemical analysis Chemical analysis (%) | | | | | | | | |
|---|---|---|---|---|---|---|---|---|
| Fe | $SiO_2$ | P | $Al_2O_3$ | Mn | $TiO_2$ | CaO | MgO | LOI |
| 57.0 | 6.23 | 0.196 | 1.610 | 0.263 | 0.104 | 0.023 | 0.112 | 9.99 |

TABLE 2b

| Particle size distribution of tests with high acceleration screen | | | | | | |
|---|---|---|---|---|---|---|
| Mesh | Test 1 Particle Size Distribution (%) | | | Test 2 Particle Size Distribution (%) | | |
| (mm) | Feed | Undersize | Oversize | Feed | Undersize | Oversize |
| 40,000 | 100.00 | 100.00 | 100.00 | 100.00 | 100.00 | 100.00 |
| 31,500 | 98.04 | 100.00 | 96.69 | 98.38 | 100.00 | 97.50 |
| 25,000 | 96.38 | 100.00 | 93.89 | 97.79 | 100.00 | 96.59 |
| 19,000 | 92.17 | 100.00 | 86.79 | 95.07 | 100.00 | 92.40 |
| 16,000 | 90.09 | 100.00 | 83.27 | 92.63 | 100.00 | 88.64 |
| 12,500 | 86.11 | 100.00 | 76.57 | 88.87 | 100.00 | 82.84 |
| 10,000 | 82.59 | 100.00 | 70.62 | 85.43 | 100.00 | 77.54 |
| 8,000 | 79.09 | 100.00 | 64.72 | 82.21 | 100.00 | 72.57 |
| 6,300 | 75.60 | 100.00 | 58.83 | 78.23 | 100.00 | 66.44 |
| 2,400 | 57.07 | 99.27 | 28.05 | 57.64 | 99.50 | 34.97 |
| 1,000 | 48.37 | 88.05 | 21.09 | 47.01 | 86.52 | 25.62 |
| 840 | 47.30 | 85.75 | 20.86 | 45.75 | 83.34 | 25.40 |
| 710 | 45.93 | 82.71 | 20.64 | 44.22 | 79.48 | 25.12 |
| 500 | 43.42 | 77.12 | 20.25 | 41.58 | 72.67 | 24.74 |
| 210 | 37.50 | 64.55 | 18.90 | 35.58 | 58.24 | 23.31 |
| 150 | 34.83 | 59.25 | 18.04 | 33.11 | 53.11 | 22.28 |
| 106 | 32.20 | 54.09 | 17.14 | 31.06 | 49.34 | 21.17 |
| 74 | 31.54 | 52.92 | 16.84 | 29.16 | 44.80 | 20.69 |
| 45 | 26.16 | 43.86 | 14.00 | 24.90 | 38.04 | 17.78 |
| 37 | 23.77 | 39.36 | 13.05 | 23.32 | 35.60 | 16.66 |
| 25 | 18.69 | 30.06 | 10.87 | 19.70 | 30.13 | 14.05 |

TABLE 2b-continued

| Particle size distribution of tests with high acceleration screen | | | | | | |
|---|---|---|---|---|---|---|
| Mesh | Test 1 Particle Size Distribution (%) | | | Test 2 Particle Size Distribution (%) | | |
| (mm) | Feed | Undersize | Oversize | Feed | Undersize | Oversize |
| 15 | 12.93 | 19.95 | 8.10 | 15.00 | 23.15 | 10.59 |
| 10 | 9.40 | 14.00 | 6.24 | 11.72 | 18.26 | 8.17 |

TABLE 3c

| Mass balance of tests with high acceleration screen. | | | | | |
|---|---|---|---|---|---|
| | Flow | % Mass | | Flow | % Mass |
| Test 1 | Feed | 100.00 | Test 2 | Feed | 100.00 |
| | Undersize | 40.70 | | Undersize | 35.10 |
| | Oversize | 59.30 | | Oversize | 64.90 |

Example 2

Tests were performed on the HPGR and the test results are presented in table 2. After two processing runs in the same equipment, it was possible to obtain 56% of material retained in a 0.074 mm mesh. This highlights the high reduction ratio of fine particles.

TABLE 4

| Particle size distribution of the HPGR tests. | | | | | | | | | |
|---|---|---|---|---|---|---|---|---|---|
| | Press feed | | | 1st run | | | 2nd run | | |
| Size (mm) | % Individual Retained | % Accumulated Retained | % Passing | % Individual Retained | % Retained | % Passing | % Individual Retained | % Accumulated Retained | % Passing |
| 3.360 | 0.39 | 0.39 | 99.61 | 0.02 | 0.02 | 99.98 | 0.01 | 0.01 | 99.99 |
| 1.000 | 38.53 | 38.92 | 61.08 | 21.16 | 21.18 | 78.82 | 13.72 | 13.72 | 86.28 |
| 0.710 | 4.68 | 43.60 | 56.40 | 5.75 | 26.93 | 73.07 | 4.57 | 18.29 | 81.71 |
| 0.500 | 5.13 | 48.73 | 51.27 | 5.55 | 32.47 | 67.53 | 4.59 | 22.88 | 77.12 |
| 0.420 | 1.89 | 50.62 | 49.38 | 2.65 | 35.12 | 64.88 | 2.40 | 25.28 | 74.72 |
| 0.300 | 5.71 | 56.33 | 43.67 | 6.32 | 41.45 | 58.55 | 6.96 | 32.24 | 67.76 |
| 0.210 | 4.18 | 60.51 | 39.49 | 5.00 | 46.45 | 53.55 | 5.37 | 37.61 | 62.39 |
| 0.150 | 6.02 | 66.53 | 33.47 | 7.42 | 53.86 | 46.14 | 7.48 | 45.09 | 54.91 |
| 0.074 | 7.06 | 73.59 | 26.41 | 9.77 | 63.63 | 36.37 | 11.42 | 56.50 | 43.50 |
| 0.045 | 4.33 | 77.93 | 22.07 | 6.18 | 69.81 | 30.19 | 7.30 | 63.81 | 36.19 |
| bypass | 22.07 | 100.00 | 0.00 | 30.19 | 100.00 | 0.00 | 36.19 | 100.00 | 0.00 |

Example 3

Tests were performed in a vertical roller mill (VRM) and the results are presented in table 3. The tests were performed under high and low pressure conditions, 500 psi and 300 psi respectively, and under both conditions it was possible to reduce the material above 1 mm, which shows the good reduction ratio of particles in thicker fractions.

TABLE 5

Particle size distribution of tests with vertical roller mill.

| Size | High Pressure-1 run | | Low Pressure-2 runs | |
|---|---|---|---|---|
| (mm) | Feed | Product | Feed | Product |
| 9.525 | 100.00 | 100.00 | 100.00 | 100.00 |
| 6.350 | 98.72 | 100.00 | 100.00 | 100.00 |
| 4.750 | 96.82 | 100.00 | 100.00 | 100.00 |
| 3.350 | 95.92 | 100.00 | 99.90 | 100.00 |
| 2.360 | 94.80 | 99.89 | 99.90 | 100.00 |
| 1.700 | 94.08 | 99.78 | 99.40 | 99.90 |
| 1.180 | 93.35 | 99.44 | 98.70 | 99.70 |
| 0.850 | 92.79 | 98.65 | 94.60 | 98.80 |
| 0.600 | 92.29 | 97.75 | 96.60 | 97.90 |
| 0.425 | 91.34 | 96.86 | 95.80 | 97.00 |
| 0.300 | 90.89 | 96.07 | 95.00 | 96.10 |
| 0.212 | 89.83 | 95.12 | 94.10 | 95.30 |
| 0.150 | 86.26 | 93.04 | 92.10 | 94.10 |
| 0.106 | 78.99 | 88.43 | 89.20 | 91.90 |
| 0.090 | 71.90 | 80.97 | 85.40 | 89.40 |
| 0.075 | 63.91 | 76.59 | 80.70 | 85.00 |
| 0.045 | 33.41 | 55.81 | 56.20 | 63.90 |

Example 4

Pilot tests were performed using a roller crusher (RC) with iron ore with about 43% retained in 1 mm and the results are presented in table 4, showing that it is possible to reduce the material above 1 mm and provide a high generation of fine particles (less than 0.075 mm) Tests have shown that the roller crusher is efficient in reducing size for various initial particle sizes.

TABLE 4

Particle size distribution of roller crusher tests.

| Size (mm) | Feed | 1 Run | 2 Runs | 4 Runs | 5 Runs | 6 Runs |
|---|---|---|---|---|---|---|
| 1.00 | 43.68 | 13.34 | 3.88 | 0.36 | 0.2 | 0.12 |
| 0.500 | 56.86 | 25.92 | 15.39 | 6.09 | 3.99 | 2.00 |
| 0.150 | 79.93 | 45.12 | 33.00 | 28.70 | 25.43 | 21.71 |
| 0.106 | 84.40 | 50.21 | 37.41 | 35.75 | 32.36 | 28.81 |
| 0.075 | 88.47 | 53.73 | 40.31 | 41.29 | 37.78 | 33.25 |
| 0.045 | | 56.79 | 42.70 | 46.40 | 42.32 | 35.99 |

Numerous variations on the scope of protection of this application are permitted. Thus, it is emphasized that the present invention is not limited to the particular configurations/embodiments described above.

The invention claimed is:

1. A process for comminuting an iron ore at natural moisture or an iron ore product at natural moisture, comprising:

milling with a vertical roller mill comprising a rotatable turntable and rollers arranged thereon with the iron ore at natural moisture or the iron ore product at natural moisture being comminuted therebetween, and pressing with a high-pressure grinding rolls roller press comprising a pair of oppositely rotating rollers supported on a rigid frame the iron ore at natural moisture or the iron ore product at natural moisture, wherein the process includes the vertical roller mill followed by the high-pressure grinding rolls roller press in series, and wherein a moisture content of the iron ore at natural moisture or the iron ore product at natural moisture is not adjusted prior to milling.

2. The process according to claim 1, further comprising screening in a high-acceleration screen of at least 10G, wherein the process includes the high-pressure grinding rolls roller press with the screening performed in the high-acceleration screen of at least 10G in a closed circuit.

3. The process according to claim 1, further comprising screening in a high-acceleration screen of at least 10G, wherein the process includes the vertical roller mill with the screening performed in the high-acceleration screen of at least 10G in a closed circuit.

4. The process according to claim 1, further comprising screening in a high-acceleration screen of at least 10G, wherein the process includes the vertical roller mill, then the high-pressure grinding rolls roller press, followed by the screening in the high-acceleration screen of at least 10G in closed circuit.

5. The process according to claim 1, further comprising screening in a high-acceleration screen of at least 10G, wherein the process includes the screening in the high-acceleration screen of at least 10G followed by the high-pressure grinding rolls roller press.

6. The process according to claim 1, wherein the iron ore at natural moisture is from a run-of-mine and the iron ore product at natural moisture is pellet feed or sinter feed.

7. The process according to claim 1, wherein the iron ore at natural moisture or the iron ore product at natural moisture has up to 12% moisture by weight.

8. The process according to claim 1, wherein a final comminution product has a particle size of less than 16 mm.

9. The process according to claim 1, wherein a final comminution product has a particle size of less than 8 mm.

10. The process according to claim 1, wherein a final comminution product has a particle size of less than 0.074 mm.

11. The process according to claim 1, wherein grinding on the high-pressure grinding rolls roller press or the vertical roller mill is carried out in up to three steps.

12. The process according to claim 1, further comprising screening with a high-acceleration screen of at least 10G.

* * * * *